US008607980B2

(12) United States Patent
Aldridge et al.

(10) Patent No.: US 8,607,980 B2
(45) Date of Patent: Dec. 17, 2013

(54) OPENABLE AND RECLOSABLE SEALED PACKAGE FOR CONFECTIONERY PRODUCTS

(75) Inventors: Allen S. Aldridge, South Orange, NJ (US); James Glydon, Cedar Knolls, NJ (US)

(73) Assignee: Kraft Foods Global Brands LLC, Northfield, IL (US)

( * ) Notice: Subject to any disclaimer, the term of this patent is extended or adjusted under 35 U.S.C. 154(b) by 0 days.

(21) Appl. No.: 13/146,947

(22) PCT Filed: Jan. 29, 2010

(86) PCT No.: PCT/US2010/022544

§ 371 (c)(1),
(2), (4) Date: Aug. 31, 2011

(87) PCT Pub. No.: WO2010/088492

PCT Pub. Date: Aug. 5, 2010

(65) Prior Publication Data

US 2011/0303574 A1 Dec. 15, 2011

Related U.S. Application Data

(60) Provisional application No. 61/206,629, filed on Feb. 2, 2009, provisional application No. 61/208,134, filed on Feb. 20, 2009, provisional application No. 61/249,654, filed on Oct. 8, 2009.

(51) Int. Cl.
*B65D 85/60* (2006.01)
*B65D 75/00* (2006.01)

(52) U.S. Cl.
USPC ..... 206/460; 206/800; 229/87.07

(58) Field of Classification Search
USPC ..... 206/460, 738, 800; 229/87.01–87.13, 229/149, 155, 160.1; 426/115
See application file for complete search history.

(56) References Cited

U.S. PATENT DOCUMENTS 183,466 A 10/1876 Pearl
202,210 A 4/1878 Zerban (Continued)

FOREIGN PATENT DOCUMENTS

BE 417615 10/1936
CN 1331646 1/2002

(Continued)

OTHER PUBLICATIONS

Mr. Brown Chewing Gum, Product Description, p. 1, http://www.gnpd.com, Feb. 7, 2000.

(Continued)

*Primary Examiner* — Bryon Gehman
(74) *Attorney, Agent, or Firm* — Hoffmann & Baron, LLP

(57) ABSTRACT

A reclosable consumer product package assembly (10) supports a plurality of consumable products (12). The product package retains and encloses the products, The package is formed from a planar sheet (16) folded about the products. The folded sheet (16) defines a portion overlying the products and an extending portion extending beyond the products to define a foldable flap (29). The sheet is scored at a location overlying at least a portion of the products. The foldable flap is folded over the scored location and adhesively secured thereto such that upon opening the flap, the scored location is removed from its overlying location to expose the products for dispensing. The flap is reclosable over the exposed products.

19 Claims, 11 Drawing Sheets

(56) References Cited

U.S. PATENT DOCUMENTS

| | | | |
|---|---|---|---|
| 271,580 | A | 1/1883 | Jones |
| 276,171 | A | 4/1883 | Fraser |
| 329,134 | A | 10/1885 | Brotz |
| 528,186 | A | 10/1894 | Strakosch |
| 603,872 | A | 5/1898 | Bucklin |
| 624,583 | A | 5/1899 | Vierengel |
| 656,349 | A | 8/1900 | Hilson |
| 732,844 | A | 7/1903 | Gerbereux |
| 924,275 | A | 6/1909 | Richardson |
| 1,037,218 | A | 9/1912 | Dirnberger |
| 1,096,909 | A | 5/1914 | Harvey |
| 1,132,781 | A | 3/1915 | Lile |
| 1,144,559 | A | 6/1915 | Mendelson et al. |
| 1,193,423 | A | 8/1916 | Pryor |
| 1,216,259 | A | 2/1917 | Armstrong |
| 1,253,219 | A | 1/1918 | Dula |
| 1,275,904 | A | 8/1918 | Grotta |
| 1,320,287 | A | 10/1919 | Stern |
| 1,382,459 | A | 6/1921 | Bercovici |
| 1,432,932 | A | 10/1922 | Weis |
| 1,433,439 | A | 10/1922 | Weis |
| 1,469,080 | A | 9/1923 | Goerk |
| 1,490,529 | A | 4/1924 | Dittgen |
| 1,550,966 | A | 8/1925 | Kappes |
| 1,575,420 | A | 3/1926 | Eisenstark et al. |
| 1,625,651 | A | 4/1927 | Gretsch |
| 1,683,651 | A | 9/1928 | Bovard |
| 1,684,381 | A | 9/1928 | Bahr |
| 1,735,325 | A | 11/1929 | L'enfant |
| 1,751,208 | A | 3/1930 | Kappes |
| 1,755,579 | A | 4/1930 | Grupe |
| 1,763,763 | A | 6/1930 | Denmead |
| 1,805,417 | A | 5/1931 | Ritzel |
| 1,805,418 | A | 5/1931 | Ritzel |
| 1,806,905 | A | 5/1931 | Kampfman |
| 1,800,000 | A | 9/1931 | Molins |
| 1,854,849 | A | 4/1932 | Lerch |
| 1,863,190 | A | 6/1932 | Coulapides |
| 1,864,493 | A | 6/1932 | Bombard et al. |
| 1,865,535 | A | 7/1932 | Meany |
| 1,870,299 | A | 8/1932 | Strelitz |
| 1,871,426 | A | 8/1932 | Schmitt |
| 1,875,197 | A | 8/1932 | Molins |
| 1,895,233 | A | 1/1933 | Rossen |
| 1,906,742 | A | 5/1933 | Coulapides |
| 1,929,148 | A | 10/1933 | Molins et al. |
| 2,008,168 | A | 7/1935 | Bergstein |
| 2,008,361 | A | 7/1935 | Lindsey |
| 2,031,011 | A | 2/1936 | Solon |
| 2,032,661 | A | 3/1936 | Linker |
| 2,039,491 | A | 5/1936 | Nolan |
| 2,042,073 | A | 5/1936 | Rose |
| 2,049,124 | A | 7/1936 | Linderman |
| 2,074,451 | A | 3/1937 | Berberian |
| 2,085,728 | A | 7/1937 | Clark |
| 2,117,281 | A | 5/1938 | Bravi |
| 2,118,849 | A | 5/1938 | Lindsey |
| 2,128,843 | A | 8/1938 | Mullins |
| 2,140,748 | A | 12/1938 | Johanson |
| 2,158,971 | A | 5/1939 | Stratton |
| 2,165,539 | A | 7/1939 | Dahlgren |
| 2,192,472 | A | 3/1940 | Huston |
| 2,192,473 | A | 3/1940 | Huston |
| 2,197,219 | A | 4/1940 | Gorshong |
| 2,933,182 | A | 4/1940 | Davis |
| 2,201,956 | A | 5/1940 | Little |
| 2,208,229 | A | 7/1940 | Ranney |
| 2,210,194 | A | 8/1940 | Baldwin |
| 2,210,195 | A | 8/1940 | Baldwin |
| 2,210,196 | A | 8/1940 | Baldwin |
| 2,212,773 | A | 8/1940 | Gray |
| 2,251,102 | A | 7/1941 | Atterberg |
| 2,258,716 | A | 10/1941 | Ralph et al. |
| 2,263,191 | A | 11/1941 | Saladin et al. |
| 2,268,379 | A | 12/1941 | Bird et al. |
| 2,276,577 | A | 3/1942 | Hahn |
| 2,277,097 | A | 3/1942 | Hansen |
| 2,298,028 | A | 10/1942 | Bazley |
| 2,327,301 | A | 8/1943 | Davis |
| 2,343,222 | A | 2/1944 | Nelson |
| 2,379,934 | A | 7/1945 | Sieferth |
| 2,380,367 | A | 7/1945 | Ranney |
| 2,470,388 | A | 5/1949 | Ball |
| 2,547,779 | A | 4/1951 | Renyck |
| 2,563,689 | A | 8/1951 | Muhlhauser |
| 2,578,583 | A | 12/1951 | O'Brien |
| 2,605,897 | A | 8/1952 | Rundle |
| 2,619,092 | A | 11/1952 | Ayers |
| 2,619,226 | A | 11/1952 | Adams |
| 2,682,475 | A | 6/1954 | Smith |
| 2,719,663 | A | 10/1955 | Meyer-Jagenberg |
| 2,744,624 | A | 5/1956 | Hoogstoel et al. |
| 2,755,918 | A | 7/1956 | Gargagliano |
| 2,799,441 | A | 7/1957 | Nerney |
| 2,801,002 | A | 7/1957 | Volckening et al. |
| 2,803,376 | A | 8/1957 | Kampff |
| 2,812,057 | A | 11/1957 | Brownfield |
| 2,820,545 | A | 1/1958 | Bramhill |
| 2,823,798 | A | 2/1958 | Volckening et al. |
| 2,858,060 | A | 10/1958 | Kuchler |
| 2,871,080 | A | 1/1959 | Shelly |
| 2,883,045 | A | 4/1959 | Abramson |
| 2,923,110 | A | 2/1960 | Tamarin |
| 2,954,116 | A | 9/1960 | Maso et al. |
| 2,962,161 | A | 11/1960 | Lacy |
| 2,980,240 | A | 4/1961 | Amatel |
| 2,988,209 | A | 6/1961 | Parrilla |
| 3,002,674 | A | 10/1961 | Wright |
| 3,027,998 | A | 4/1962 | Ridgway |
| 3,035,756 | A | 5/1962 | Mullinix |
| 3,047,144 | A | 7/1962 | Wissel |
| 3,069,003 | A | 12/1962 | Amatel |
| 3,071,244 | A | 1/1963 | Doran |
| 3,092,501 | A | 6/1963 | Beck et al. |
| 3,108,711 | A | 10/1963 | Anton |
| 3,113,673 | A | 12/1963 | Stein |
| 3,118,588 | A | 1/1964 | Noble |
| 3,152,694 | A | 10/1964 | Nashed et al. |
| 3,165,249 | A | 1/1965 | Peck |
| 3,187,889 | A | 6/1965 | Sinclair |
| 3,201,258 | A | 8/1965 | Mastella |
| 3,201,536 | A | 8/1965 | Fisher et al. |
| 3,204,759 | A | 9/1965 | Palmer |
| 3,206,094 | A | 9/1965 | Humphrey et al. |
| 3,224,922 | A | 12/1965 | Fry, Jr. |
| 3,272,423 | A | 9/1966 | Bjarno |
| 3,282,413 | A | 11/1966 | Sparks |
| 3,322,323 | A | 5/1967 | Greene et al. |
| 3,323,643 | A | 6/1967 | Rush |
| 3,367,552 | A | 2/1968 | Krzyanowski |
| 3,374,884 | A | 3/1968 | Chinkes |
| 3,389,784 | A | 6/1968 | Hendricks et al. |
| 3,389,852 | A | 6/1968 | Egli |
| 3,438,565 | A | 4/1969 | Lugt et al. |
| 3,509,989 | A | 5/1970 | Woll |
| 3,524,583 | A | 8/1970 | Gregory |
| 3,542,191 | A | 11/1970 | Scott |
| 3,580,466 | A | 5/1971 | Thelen |
| 3,583,358 | A | 6/1971 | Hanson, Jr. |
| 3,591,071 | A | 7/1971 | Rosenburg, Jr. |
| 3,623,653 | A | 11/1971 | Work |
| 3,642,564 | A | 2/1972 | Walker et al. |
| 3,664,572 | A | 5/1972 | Puchkoff et al. |
| 3,708,946 | A | 1/1973 | Cahill |
| 3,732,663 | A | 5/1973 | Geldmacher |
| 3,734,280 | A | 5/1973 | Amneus et al. |
| 3,734,801 | A | 5/1973 | Sebel |
| 3,756,385 | A | 9/1973 | Steinbock |
| 3,835,989 | A | 9/1974 | Mori et al. |
| 3,881,649 | A | 5/1975 | Krautsack |
| 3,923,239 | A | 12/1975 | Lee |
| 3,924,739 | A | 12/1975 | Gravesteijn |
| 3,938,655 | A | 2/1976 | Romolt |
| 3,966,045 | A | 6/1976 | Perdue |

(56) References Cited

U.S. PATENT DOCUMENTS

| | | | | |
|---|---|---|---|---|
| 3,991,168 | A | 11/1976 | Richards et al. | |
| 4,015,770 | A | 4/1977 | Tamarin | |
| 4,053,049 | A | 10/1977 | Beauvais | |
| 4,082,594 | A * | 4/1978 | Stonehouse | 229/87.07 |
| 4,101,024 | A | 7/1978 | Furuya et al. | |
| 4,119,196 | A | 10/1978 | Flaherty | |
| 4,125,189 | A | 11/1978 | Fujimoto et al. | |
| 4,131,195 | A | 12/1978 | Worrell, Sr. | |
| D250,748 | S | 1/1979 | Leger | |
| 4,142,635 | A | 3/1979 | Capo et al. | |
| 4,192,420 | A | 3/1980 | Worrell, Sr. et al. | |
| 4,197,949 | A | 4/1980 | Carlsson | |
| 4,216,898 | A | 8/1980 | Davies | |
| 4,234,084 | A | 11/1980 | Hutten | |
| 4,260,061 | A | 4/1981 | Jacobs | |
| RE30,616 | E | 5/1981 | Hofer | |
| 4,294,353 | A | 10/1981 | Focke et al. | |
| 4,360,106 | A | 11/1982 | Irvine et al. | |
| 4,377,235 | A | 3/1983 | Carver | |
| 4,411,365 | A | 10/1983 | Horikawa et al. | |
| 4,436,205 | A | 3/1984 | Horii | |
| 4,441,611 | A | 4/1984 | Sommariva | |
| 4,464,154 | A | 8/1984 | Ljungcrantz | |
| 4,470,508 | A | 9/1984 | Yen | |
| 4,546,875 | A | 10/1985 | Zweber | |
| 4,552,269 | A | 11/1985 | Chang | |
| 4,610,357 | A | 9/1986 | Nakamura | |
| 4,637,544 | A | 1/1987 | Quercetti | |
| 4,658,963 | A | 4/1987 | Jud | |
| 4,666,040 | A | 5/1987 | Murata | |
| 4,679,693 | A | 7/1987 | Forman | |
| 4,738,359 | A | 4/1988 | Phillips, Jr. | |
| 4,850,482 | A | 7/1989 | Campbell | |
| 4,874,096 | A | 10/1989 | Tessera-Chiesa | |
| 4,902,142 | A | 2/1990 | Lammert et al. | |
| 4,912,910 | A | 4/1990 | Lowe et al. | |
| 4,949,841 | A | 8/1990 | Focke et al. | |
| 4,961,496 | A | 10/1990 | Focke et al. | |
| 4,997,082 | A | 3/1991 | Durocher | |
| 5,029,712 | A | 7/1991 | O'Brien et al. | |
| 5,078,509 | A | 1/1992 | Center et al. | |
| 5,080,227 | A | 1/1992 | Focke | |
| 5,092,465 | A | 3/1992 | Weder et al. | |
| 5,096,113 | A | 3/1992 | Focke | |
| 5,123,589 | A | 6/1992 | Cote | |
| 5,125,211 | A | 6/1992 | O'Brien et al. | |
| 5,128,157 | A | 7/1992 | Ruiz | |
| 5,145,091 | A | 9/1992 | Meyers | |
| 5,150,720 | A | 9/1992 | Focke et al. | |
| 5,192,386 | A | 3/1993 | Moir et al. | |
| 5,195,637 | A | 3/1993 | Weder | |
| 5,215,249 | A | 6/1993 | Gorrieri | |
| 5,240,109 | A | 8/1993 | Weder et al. | |
| 5,255,784 | A | 10/1993 | Weder et al. | |
| 5,290,616 | A | 3/1994 | Cowan et al. | |
| 5,301,804 | A | 4/1994 | Focke et al. | |
| 5,307,988 | A | 5/1994 | Focke et al. | |
| 5,311,992 | A | 5/1994 | Weder et al. | |
| 5,316,211 | A | 5/1994 | Chang | |
| 5,344,008 | A | 9/1994 | DeBlasio et al. | |
| D351,104 | S | 10/1994 | Kapp | |
| 5,358,171 | A | 10/1994 | Focke | |
| 5,407,072 | A | 4/1995 | Weder et al. | |
| 5,427,235 | A | 6/1995 | Powell et al. | |
| 5,435,439 | A | 7/1995 | Swart | |
| 5,462,223 | A | 10/1995 | Focke et al. | |
| D365,023 | S | 12/1995 | Abrams et al. | |
| 5,489,060 | A | 2/1996 | Godard | |
| 5,510,124 | A | 4/1996 | Kopecky et al. | |
| 5,511,658 | A | 4/1996 | Focke et al. | |
| 5,515,965 | A | 5/1996 | Boldrini et al. | |
| 5,522,205 | A | 6/1996 | Weder | |
| 5,553,773 | A | 9/1996 | Focke et al. | |
| 5,556,026 | A | 9/1996 | Blankitny | |
| 5,560,482 | A | 10/1996 | Katagiri et al. | |
| 5,575,385 | A | 11/1996 | Zona | |
| 5,607,056 | A | 3/1997 | Whiteside | |
| 5,620,550 | A | 4/1997 | Andersson et al. | |
| 5,632,378 | A | 5/1997 | Provost | |
| 5,636,732 | A | 6/1997 | Gilels et al. | |
| 5,732,823 | A | 3/1998 | Weder et al. | |
| 5,738,207 | A | 4/1998 | Trimani | |
| 5,783,266 | A | 7/1998 | Gehrke | |
| 5,797,494 | A | 8/1998 | Balling et al. | |
| 5,819,925 | A | 10/1998 | Brizzi et al. | |
| 5,823,331 | A | 10/1998 | Manservigi et al. | |
| 5,836,448 | A | 11/1998 | Weder | |
| 5,855,434 | A | 1/1999 | Hagen | |
| 5,860,524 | A | 1/1999 | Weder | |
| 5,860,526 | A | 1/1999 | Burke, Jr. | |
| 5,878,883 | A | 3/1999 | Weder | |
| 5,924,571 | A | 7/1999 | Cornelissen | |
| 5,941,641 | A | 8/1999 | Kinigakis et al. | |
| 5,944,188 | A | 8/1999 | Grosskopf et al. | |
| 5,992,621 | A | 11/1999 | Grant et al. | |
| 5,996,797 | A | 12/1999 | Flaig | |
| 6,001,397 | A | 12/1999 | Boyd et al. | |
| 6,010,724 | A | 1/2000 | Boyd et al. | |
| 6,026,953 | A | 2/2000 | Nakamura et al. | |
| D421,568 | S | 3/2000 | Ferguson et al. | |
| 6,044,848 | A | 4/2000 | Huang | |
| 6,094,917 | A | 8/2000 | Sundhar et al. | |
| 6,105,856 | A | 8/2000 | Kakiuchi | |
| 6,164,444 | A | 12/2000 | Bray et al. | |
| 6,199,687 | B1 | 3/2001 | Tambo et al. | |
| 6,202,838 | B1 | 3/2001 | Tran | |
| 6,220,430 | B1 | 4/2001 | Boriani et al. | |
| 6,228,450 | B1 | 5/2001 | Pedrini | |
| 6,237,760 | B1 | 5/2001 | Parker et al. | |
| 6,309,105 | B1 | 10/2001 | Palumbo | |
| 6,334,532 | B1 | 1/2002 | Tambo et al. | |
| 6,395,317 | B1 | 5/2002 | Singh et al. | |
| D465,416 | S | 11/2002 | Dzwill et al. | |
| 6,478,149 | B1 | 11/2002 | Parker | |
| 6,505,735 | B1 | 1/2003 | Parker | |
| D471,804 | S | 3/2003 | Staples | |
| D479,464 | S | 9/2003 | Kopecky | |
| D479,646 | S | 9/2003 | Overton | |
| 6,644,488 | B1 | 11/2003 | Coleman | |
| D484,046 | S | 12/2003 | Kopecky | |
| 6,672,035 | B1 | 1/2004 | Simonsen et al. | |
| 6,709,684 | B2 | 3/2004 | Loth | |
| 7,032,754 | B2 | 4/2006 | Kopecky | |
| 7,159,717 | B2 | 1/2007 | Aldridge et al. | |
| 7,325,686 | B2 * | 2/2008 | Aldridge | 206/800 |
| 7,467,711 | B2 | 12/2008 | Tambo | |
| 7,527,189 | B2 | 5/2009 | Billig et al. | |
| 7,533,773 | B2 | 5/2009 | Aldridge et al. | |
| 7,686,165 | B2 * | 3/2010 | Aldridge et al. | 229/87.07 |
| 7,810,641 | B2 * | 10/2010 | Hungler et al. | 229/242 |
| 7,811,614 | B2 * | 10/2010 | Aldridge | 426/115 |
| 7,901,719 | B2 * | 3/2011 | Aldridge | 206/472 |
| 7,913,846 | B2 * | 3/2011 | Aldridge et al. | 229/87.07 |
| 7,971,718 | B2 * | 7/2011 | Aldridge | 229/87.07 |
| 8,136,661 | B2 * | 3/2012 | Lutzig et al. | 229/160.1 |
| 8,172,086 | B2 * | 5/2012 | Aldridge et al. | 229/87.07 |
| 8,221,812 | B2 * | 7/2012 | Aldridge | 426/115 |
| 2002/0063079 | A1 | 5/2002 | Loth | |
| 2003/0034255 | A1 | 2/2003 | Luton et al. | |
| 2003/0047470 | A1 | 3/2003 | Parker | |
| 2003/0080020 | A1 | 5/2003 | Kopecky | |
| 2003/0106928 | A1 | 6/2003 | Li Vigni et al. | |
| 2005/0218198 | A1 | 10/2005 | Cavero et al. | |
| 2005/0276525 | A1 | 12/2005 | Hebert et al. | |
| 2006/0027483 | A1 | 2/2006 | Aldridge | |
| 2007/0134371 | A1 | 6/2007 | Billig et al. | |
| 2007/0138035 | A1 | 6/2007 | Fluegel et al. | |
| 2007/0141199 | A1 | 6/2007 | Ishikawa et al. | |

FOREIGN PATENT DOCUMENTS

| | | |
|---|---|---|
| DE | 653242 | 11/1937 |
| DE | 9405638 | 6/1994 |
| DE | 10238905 | 3/2004 |

(56) References Cited

FOREIGN PATENT DOCUMENTS

| | | |
|---|---|---|
| EP | 0 801 000 | 10/1997 |
| EP | 1367005 | 12/2003 |
| EP | 1591027 | 11/2005 |
| EP | 1595807 | 11/2005 |
| FR | 762011 | 9/1933 |
| FR | 1204079 | 10/1958 |
| GB | 461794 | 2/1937 |
| GB | 808056 | 1/1959 |
| GB | 2 074 532 | 11/1981 |
| GB | 2078202 | 1/1982 |
| GB | 2227221 | 7/1990 |
| JP | 2-138584 | 11/1990 |
| JP | 07-099891 | 4/1995 |
| JP | 09-110072 | 4/1997 |
| JP | 3022304 | 12/1997 |
| JP | 10147365 A | 6/1998 |
| JP | 11-1221 | 1/1999 |
| JP | 11-001220 | 6/1999 |
| JP | 11-301648 | 11/1999 |
| WO | 00/12407 | 3/2000 |
| WO | 01/07335 | 2/2001 |
| WO | 03/037744 | 5/2003 |
| WO | 2008051813 | 5/2008 |

OTHER PUBLICATIONS

Third Party Observations, European Patent Office, Application No. 05768974.7, 11 pages, Dec. 15, 2009.

Notice of Opposition, European Patent Office, Application No. 05748373.7, 24 pages, Apr. 7, 2010.

U.S. Appl. No. 60/560,306, filed Apr. 6, 2004, 47 pages (to which a claim of priority is made in 7,527,189; 2005/0218198; 2007/0134371; 2007/0138035; and 2007/0141199.

* cited by examiner

OPENABLE AND RECLOSABLE SEALED PACKAGE FOR CONFECTIONERY PRODUCTS

CROSS REFERENCE TO RELATED APPLICATIONS

This application is the National Stage of International Application No. PCT/US2010/022544, which designates the U.S., filed Jan. 29, 2010, which claims the benefit of U.S. Provisional Patent Application No. 61/206,629 filed on Feb. 2, 2009; U.S. Provisional Patent Application No. 61/208,134 filed on Feb. 20, 2009; and U.S. Provisional Patent Application No. 61/249,654 filed on Oct. 8, 2009, the contents of all of which are incorporated herein by reference in their entirety.

FIELD OF THE INVENTION

The present invention relates generally to a package for containing one or more confectionery products and which may be opened to permit removal of one or more products. More specifically, the present invention relates to an openable sealed pouch for containing and dispensing a plurality of confectionery products which may be repeatedly reclosed.

BACKGROUND OF THE INVENTION

Certain consumable products such as pieces of chewing gum, chocolate, candy or other confectionery products are typically housed in a package where individual products are arranged in an array which allows for ease of individually dispensing one product therefrom. As the consumer typically uses less than all of the products contained in the package at a single time, it is desirable that the package be able to be reclosed to contain the remaining products therein. One example of a reclosable product package of this type is shown in commonly assigned U.S. Patent Publication No. US-2006-0027483-A1, published on Feb. 9, 2006, which is incorporated by reference herein for all purposes. While this package serves adequately to retain and dispense individual products from the package and may be reclosed to retain the remaining products therein, the package requires both a container packet for retaining the products and a cover which overlies the container package and is adhesively attached thereto. The cover includes a flap which upon opening, opens the packet exposing the product. The cover flap may be closed to retain the products.

In order to maintain the cost effectiveness of the packaging, especially where a small number of products are desired to be housed and sold as a unit, the package should be capable of being efficiently and economically manufactured. Such efficient manufacturing would result in a cost savings for the package and thereby cost savings for the overall packaged product.

SUMMARY OF THE INVENTION

The present invention provides a reclosable consumer product package assembly. The product package assembly includes a plurality of consumable products. The product package retains and encloses the products. The package is formed from a planar sheet folded about the products. The folded sheet defines a portion overlying the products and an extending portion extending beyond the products to define a foldable flap. The sheet is scored at a location overlying at least a portion of the products. The foldable flap is folded over the scored location and adhesively secured thereto. Upon opening the flap, the scored location is removed from the overlying location to expose the products for dispensing. The flap is reclosable over the exposed products.

The flap may be adhesively secured in the reclosed position.

Additionally, the planar sheet of the package may be formed from foil or paper or combinations thereof.

The package of the present invention employs a flood coat heat seal to seal the folded sheet and a combination of permanent and releaseable cold seals for the foldable flap.

DETAILED DESCRIPTION OF THE PREFERRED EMBODIMENT

Figure 4:
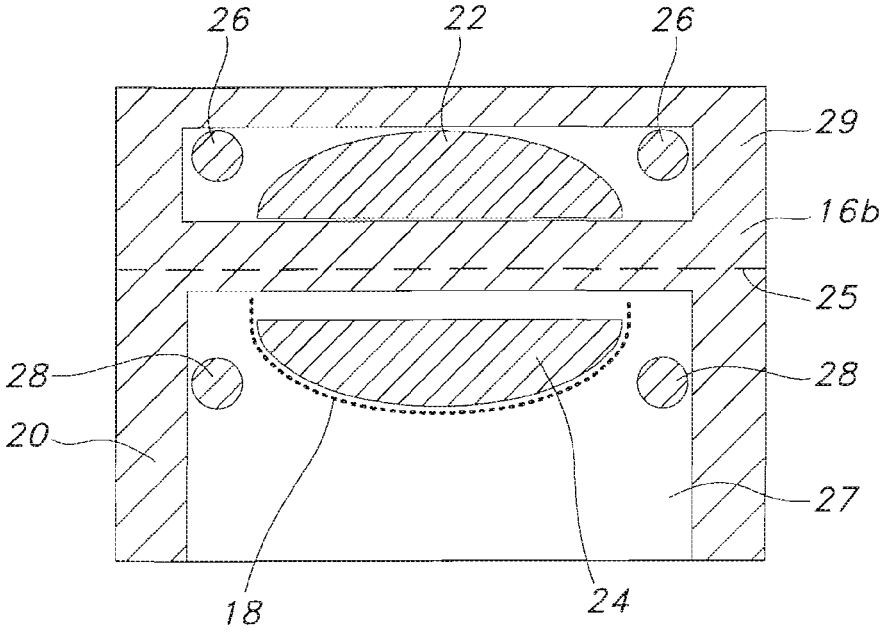
FIG. 4 shows the formed pouch of the present invention including both heat seal and cold seal locations.
Figure 5:
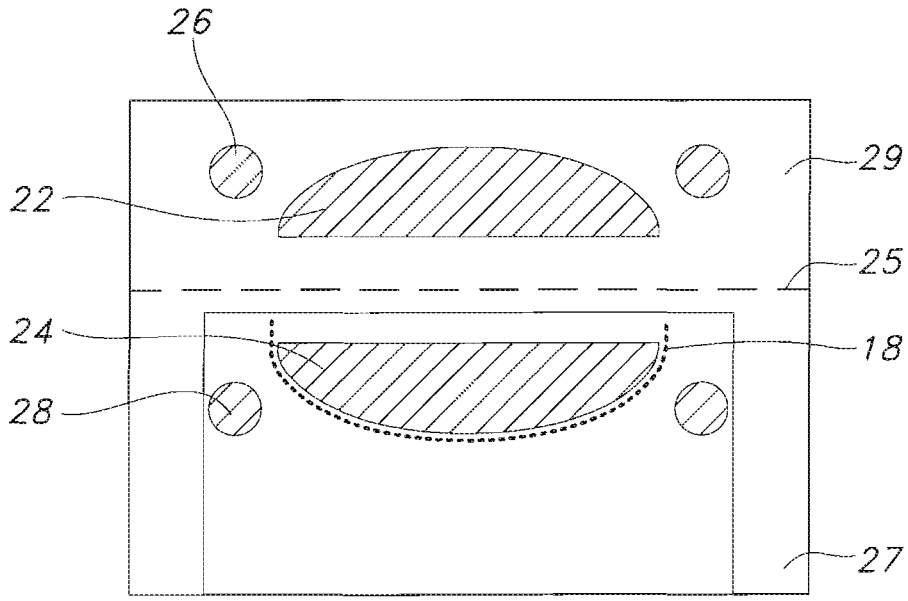
FIG. 5 shows the pouch of the present invention in an open condition.
Figure 6:
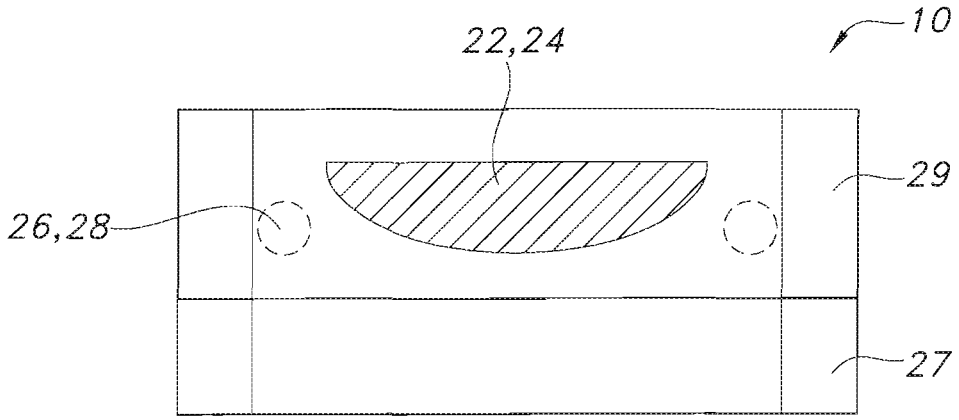
FIG. 6 shows the pouch of the present invention in a closed and sealed position.
Figure 7:
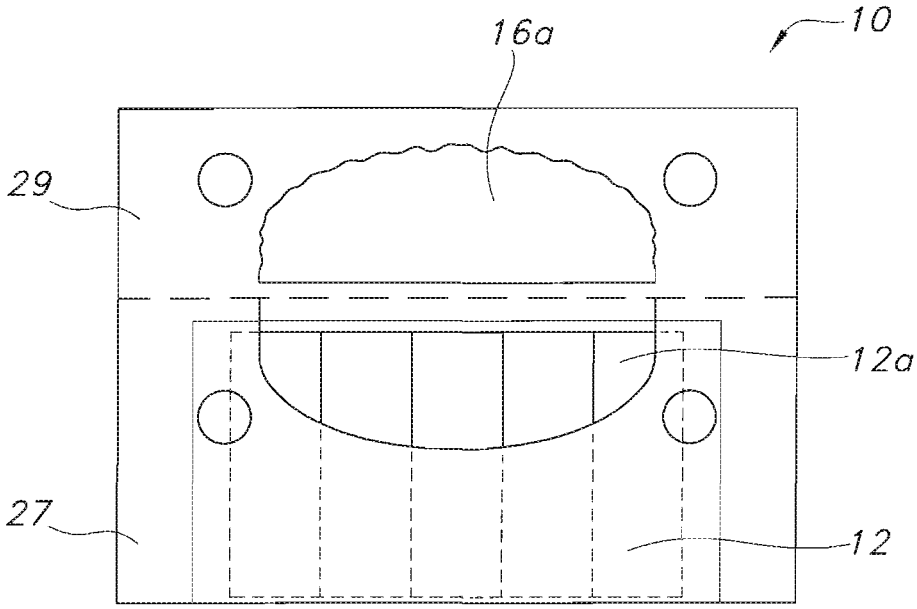
FIG. 7 shows the pouch of the present invention in an opened condition exposing the gum slabs for removal.

Referring to FIGS. 1-8, a pouch 10, shown more specifically in FIGS. 6 and 7, is used to contain and dispense a plurality of confectionery products, preferably gum sticks 12. The gum sticks are preferably wrapped in an outer wrapper and may be arranged in a side-by-side array. While wrapped gum sticks are shown, it is within the contemplation of the present invention that any configuration of gum sticks, both wrapped and unwrapped, may be employed. Furthermore, it is contemplated that the pouch 10 may be used to contain and dispense a variety of consumable products such as chewing gum, chocolate, or candy arranged in side-to-side or face-to-face orientation or any other orientation which will effectively be housed in the pouch.

Figure 1:
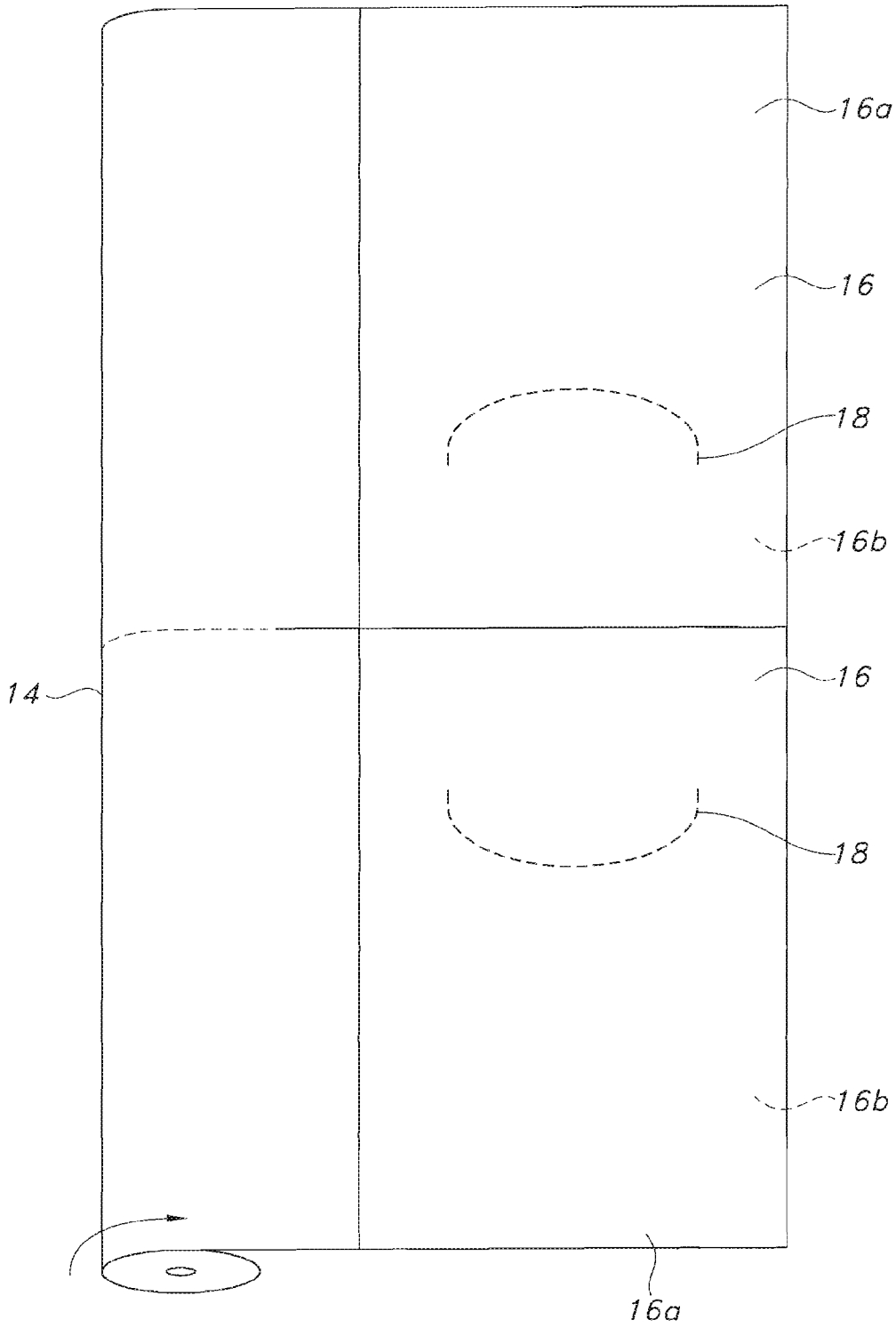
FIG. 1 is a plan view of the roll of material used to form the pouch of the present invention.

Referring more specifically to FIG. 1, the pouch of the present invention may be formed from a role 14 of material. The material may include single or multiple plies of paper, film, foil or combinations thereof. In the present illustrative embodiment, a foil material is used to form pouch 10. The roll of material 14 is flood coated with a heat activateable adhesive on one surface thereof. The flood coating covers the entire surface of the material. As will be described in detail herein below, the flood coated adhesive may be heat activated at selected locations.

Figure 3:
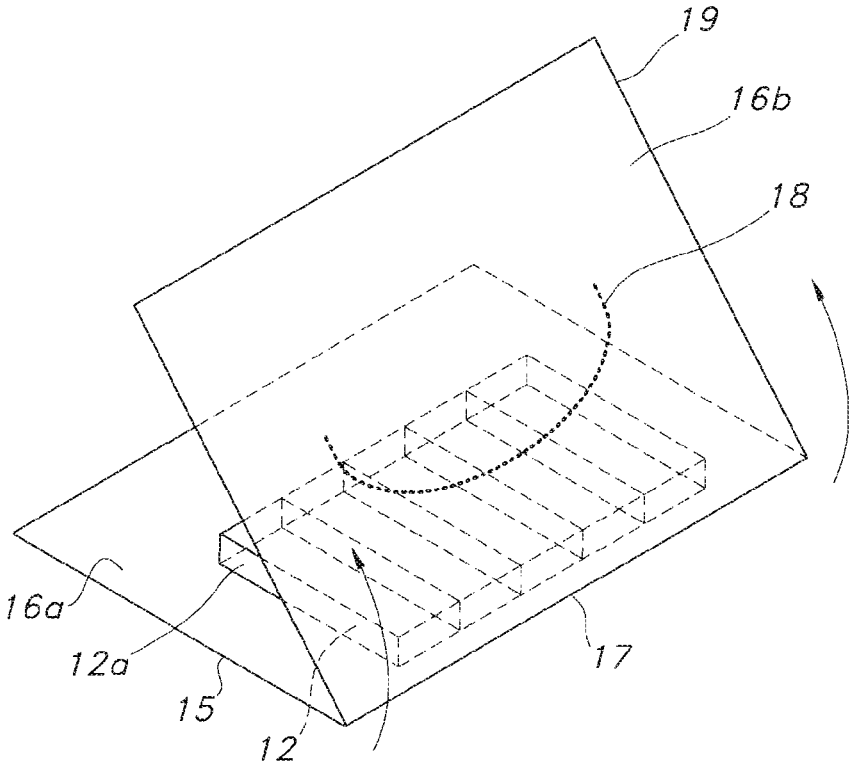
FIG. 3 shows the sheet of FIG. 2 being folded in its configuration forming a pouch.

The individual sheets 16 used to form pouch 10 are formed from the roll 14 as it is run "two up" from the roll then split to make two mirrored sheets. Each sheet 16 includes two opposed planar surfaces, a first surface 16*a* shown in FIG. 1 is the flood coated surface and a second surface 16*b* shown in FIGS. 3 and 4 is on the opposite side thereof. Once the sheets 16 are cut from the roll 14, each sheet is provided with both permanent and repositionable seal locations on opposite surface 16*b*. This arrangement of the heat seal on one surface of the sheet and the repositionable seal on the opposite surface allows for manufacturing expediency as the materials may be supplied on the roll with the heat activated adhesive place on one side thereof.

The preferred repositionable seal is a cold seal, however, the invention is not limited to a repositionable cold seal. It is contemplated that other repositionable seals may also be employed. For example, a hot melt adhesive may also be employed. A hot melt adhesive could provide similar repositionable characteristics as a cold seal.

A laser score 18 is placed in the sheet 16 adjacent one end thereof. The laser score 18 has a generally curved or "smile cut" shape. The laser score 18 is placed to a depth which allows for easy tearing, but does not extend all the way through the sheet so as to maintain the hairier properties of the sheet. While a laser score is shown herein as a preferred embodiment, any similar partial scoring or cutting into the sheet may be employed including perforations and the like. Such perforations may be placed into the sheet by use of roller discs or other conventional perforating techniques.

Figure 2:
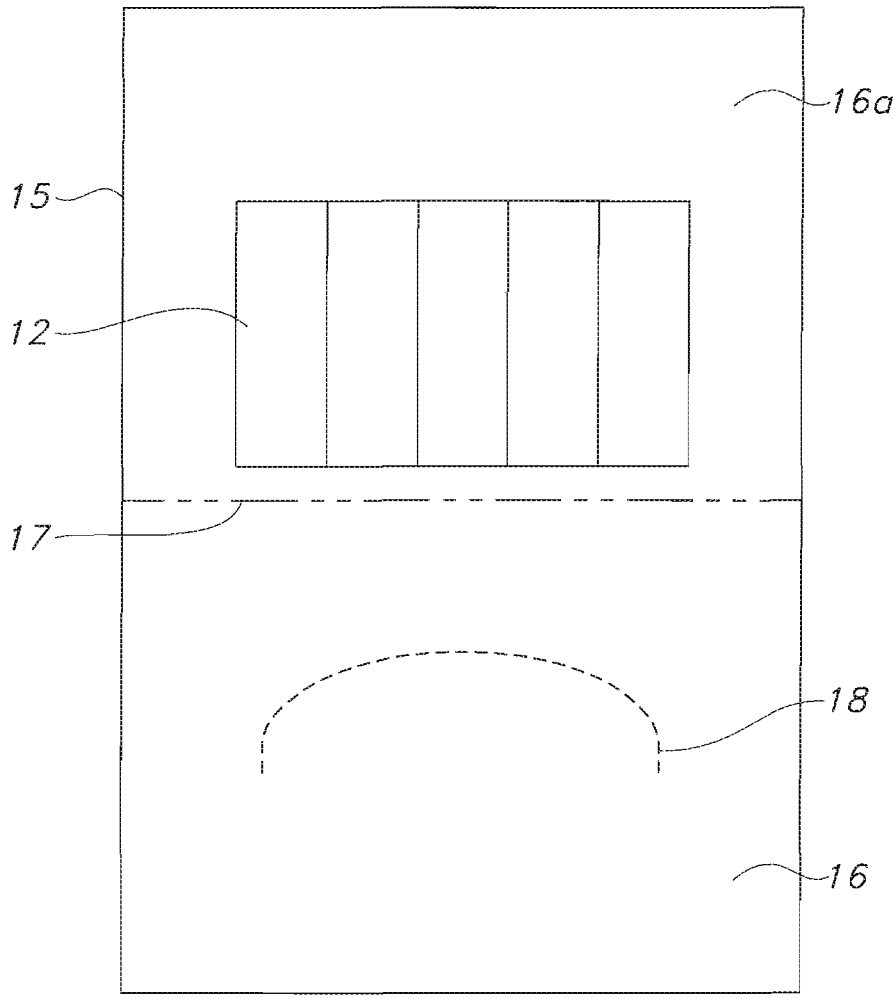
FIG. 2 is a plan view of a sheet cut from the roll of material of FIG. 1 used to form a pouch of the present invention.

Referring to FIG. 2, one sheet 16 from roll 14 may be used to form the pouch 10 of the present invention. A plurality of wrapped gum sticks 12 are placed on the sheet 16 on the upper half 15 thereof above a horizontal fold line 17. A slight adhesive tack may be used to support the gum sticks 12 on surface 16*a* of sheet 16.

As shown in FIG. 3, the lower half 19 of sheet 16 may be folded along fold line 17 and brought up over the gum sticks 12 supported on the upper half 15. When so folded, the laser score 18 is positioned adjacent and across the upper ends 12*a* of gum sticks 12. The folded lower half 19 is pressed against the upper half 15 to form a pouch interior 11 which support the gum sticks 12. The flood coated heat seal material is then activated along boundary locations 20 shown in hatched lines in FIG. 4. This provides a sealed pouch to sealably retain the gum sticks in pouch interior 11.

As mentioned above, opposite surface 16*b* of sheet 16 includes thereon both permanent and repositionable seal locations. As shown in FIG. 4, opposite surface 16*b* includes a pair of permanent cold seal locations 22 and 24 which are positioned on either side of a fold line 25 which separates the folded sheet 16 into a pouch-like bottom portion 27 and a foldable flap 29. The permanent cold seal locations 22 and 24 are generally semi-oval in shape and are provided and arranged such that when the flap is folded down onto the lower pouch portion, the cold seal locations overlie one another. Surface 16*b* of sheet 16 also includes a plurality of repositionable cold seal spots 26 and 28. Spots 26 and 28 are arranged on flap 29 and lower pouch portion 27 such that when the flap 29 is folded down onto the lower pouch portion 27, the releaseable cold seal spots are aligned. As noted above, white a repositionable cold seal is preferred, the location may be formed by other seals such as a hot melt seal.

As shown in FIG. 5, the permanent cold seal location 24 of lower pouch portion 27 is located within the curved laser scored location 18. When the flap 29 is folded down onto lower pouch portion 27, the cold seal locations 22 and 24 engage as do the releaseable cold seal locations 26 and 28 to close and seal the flap 29 over the lower pouch portion 27.

Figure 8:
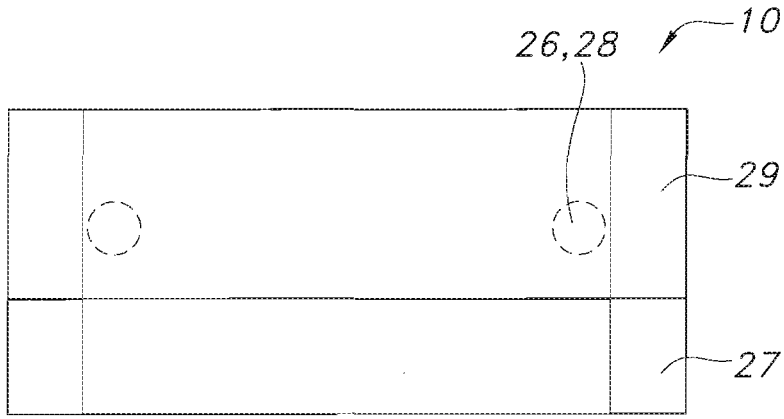
FIG. 8 shows the pouch of the present invention in a reclosed condition.

Referring now to FIGS. 7 and 8, in order to open pouch 10 to remove one or more gum sticks 12, the flap 29 is lifted off of lower pouch portion 27. The engagement between the permanent cold seal locations 22 and 24 shown in FIG. 4 results in the flap 29 being permanently adhered to the lower portion 27 adjacent the laser scored location 18 such that upon lifting the flap 29 it causes the package to tear along the laser score 18. Opening of the flap 29 thereby pulls the portion 16*a* of the sheet contained within the laser score up with the flap 29 causing the lower pouch portion 27 to be opened adjacent the upper end 12*b* of gum sticks 12. This allows the consumer to access the gum sticks for removing one or more thereof.

Once the consumer has taken the desired number of gum sticks from the pouch 10, the pouch can be reclosed by refolding flap 29 down onto lower flap portion 27. The alignment and engagement between cold seal spots 26 and 28 permit the flap 29 to remain in a closed condition over lower pouch portion 27. However, as these cold seal spots are repositionable, the flap can be opened and reclosed multiple times.

A further embodiment of the present invention is shown with respect to FIGS. 9-12 herein.

In certain situations, such as for aesthetic, printing and environmental purposes, a pouch may include a lacquer coating thereover referred to as over lacquer. In such situations, the present invention provides a further technique for providing reclosability of the pouch.

Figure 9:
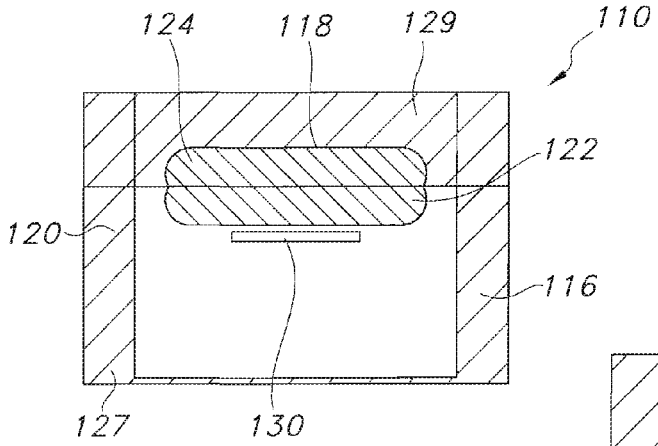
FIG. 9 shows a further embodiment of the pouch of the present invention during formation.

Referring to FIG. 9, the pouch 110 is substantially similar to pouch 10 described above and includes a sheet 116 which is folded to form the pouch. A heat seal is used on boundary location 110. A score 118 is placed in the sheet 116 having a generally curved or semi-oval configuration. The score 118 is placed to a depth which allows easy tearing but does not extend all the way through the sheet so as to maintain the barrier properties thereof. The score can be achieved preferably by laser. However, other scoring techniques such as die cutting perforations and the like can also be employed. The sheet 116 my be formed of a laminated material, whereby the score is in one layer of the laminate, or two off-set scores are provided in either layer of the laminate.

The pouch includes a pair of permanent cold seal locations 122 and 124 which are positioned on either side of a fold line 125 to separate the folded sheet 116 into a folded pouch-like bottom portion 127 and a foldable flap 129. The permanent cold seal locations 122 and 124 are provided and arranged such that when the flap 129 is folded down onto the lower pouch portion 127 the cold seal locations overlie one another. As with the above described embodiment, when the flap 129 is folded down onto the lower pouch portion 127, the cold seal locations 122 and 124 engage to close and seal the flap 129 over the lower pouch portion 127.

As with the above described embodiment, in order to open the pouch 110 to remove one or more of the gum sticks 112, the flap 129 is lifted off of the lower pouch portion 127. The engagement between the permanent cold seal locations 122 and 124 result in the flap being permanently adhered at the score location 118 such that lifting the flap 129 causes the package to tear along the score. The opening of the flap 129 thereby pulls a portion 117 of the sheet up with the flap thereby opening the pouch and exposing the gum sticks 112 contained therein.

Figure 10:
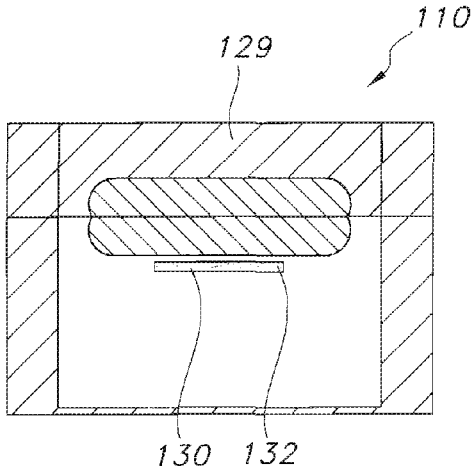
FIG. 10 shows the pouch of FIG. 9 with adhesive applied thereto.
Figure 11:
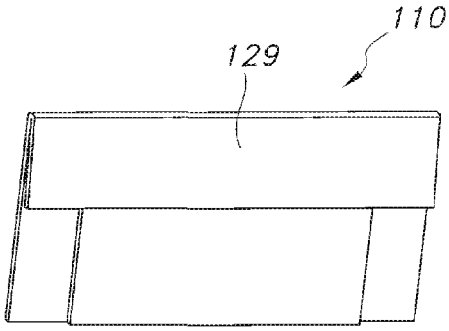
FIG. 11 shows the pouch of FIG. 9 in the closed position.
Figure 12:
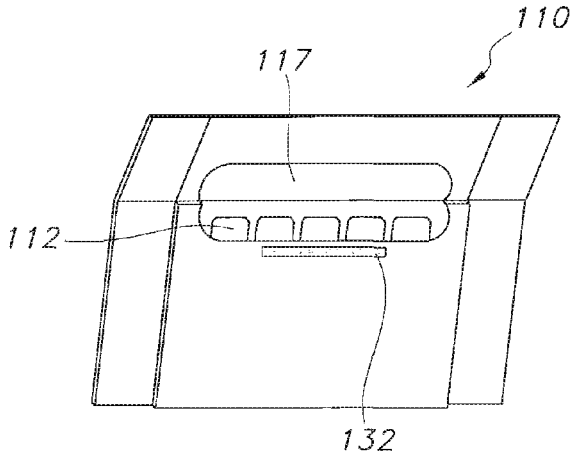
FIG. 12 shows the pouch of FIG. 9 in the open condition.

The present invention, however, provides a reclosable feature that is particularly useful with over lacquered materials. Referring again to FIG. 9, when the over lacquer is applied to the pouch, a segment 130 of the pouch beneath permanent cold seal location 122 is left with no lacquer. Various techniques and masks can be used to prevent the lacquer from being applied to this segment 130. Thereafter, as shown in FIG. 10, a tacky adhesive material 132 can be applied to the segment 130. Since there is no lacquer coating along the segment, the tacky adhesive will permanently adhere to the pouch. When the flap 129 is closed as shown in FIG. 11, not only will the cold seal locations 122 and 124 adhere, but the upper extent of the pouch 129 will adhere to the tacky adhesive 132 on the segment 130. Since the pouch is over lacquered, the adhesive connection between the tacky adhesive and the unlacquered segment 130 will be stronger than the adhesive connection between the tacky adhesive and the lacquered flap 129. Therefore, the tacky adhesive will remain adhered to the unlacquered segment 130, while the flap will be releasably adhesively secured to the tacky adhesive.

While a package having an over lacquer is shown, other package constructions such as packages with a varnish thereover or a foil package may also be used in accordance with the present invention.

Figure 13:
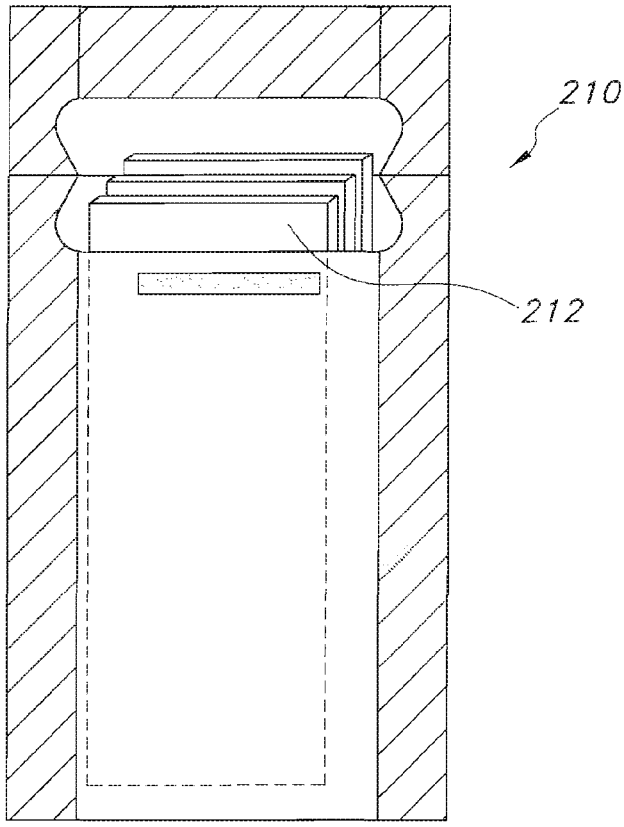
FIG. 13 shows a further embodiment of the pouch of the present invention for accommodating a plurality of gum slabs arranged in a face-to-face vertical orientation.

As noted above, the pouch of the present invention may be constructed to accommodate wrapped or unwrapped gum slabs arranged in various orientations. For example, FIG. 13 shows wrapped gum sticks 212 supported in a face-to-face upright or vertical orientation in pouch 210. The pouch 210 is configured to support sticks 212 in such orientation.

Figure 14:
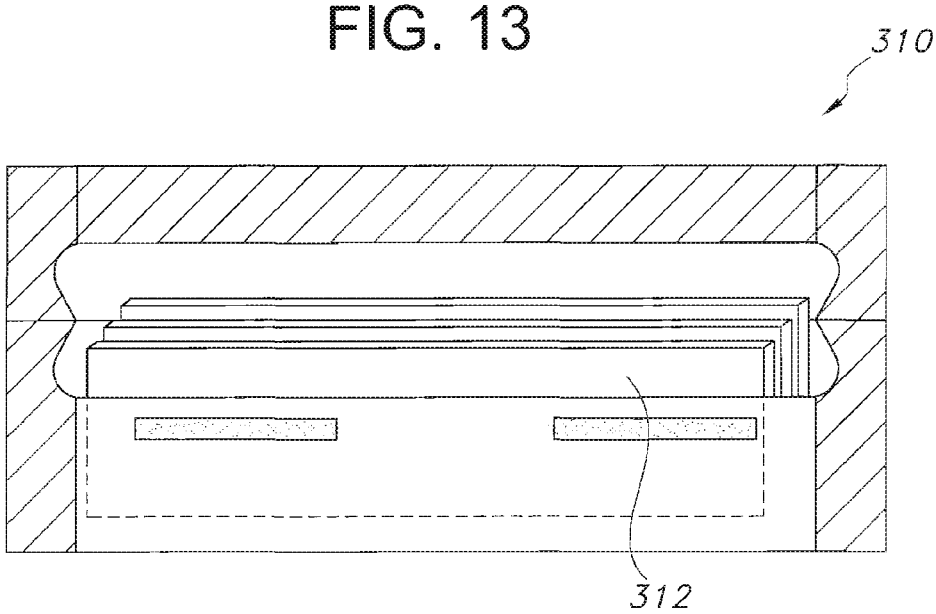
FIG. 14 shows a further embodiment of the pouch of the present invention for accommodating a plurality of gum slabs in a face-to-face horizontal orientation.

Still further as shown in FIG. 14, pouch 310 is configured to support wrapped guru sticks in a face-to-face horizontal orientation.

It, of course, should be appreciated that the embodiments shown herein are not limited to any particular configuration. The pouch may be of various sizes and shapes and may also include stand up bags and hanging bags. The sides of the pouch, including the corners, may be rounded or curves as is aesthetically desired.

Figure 15:
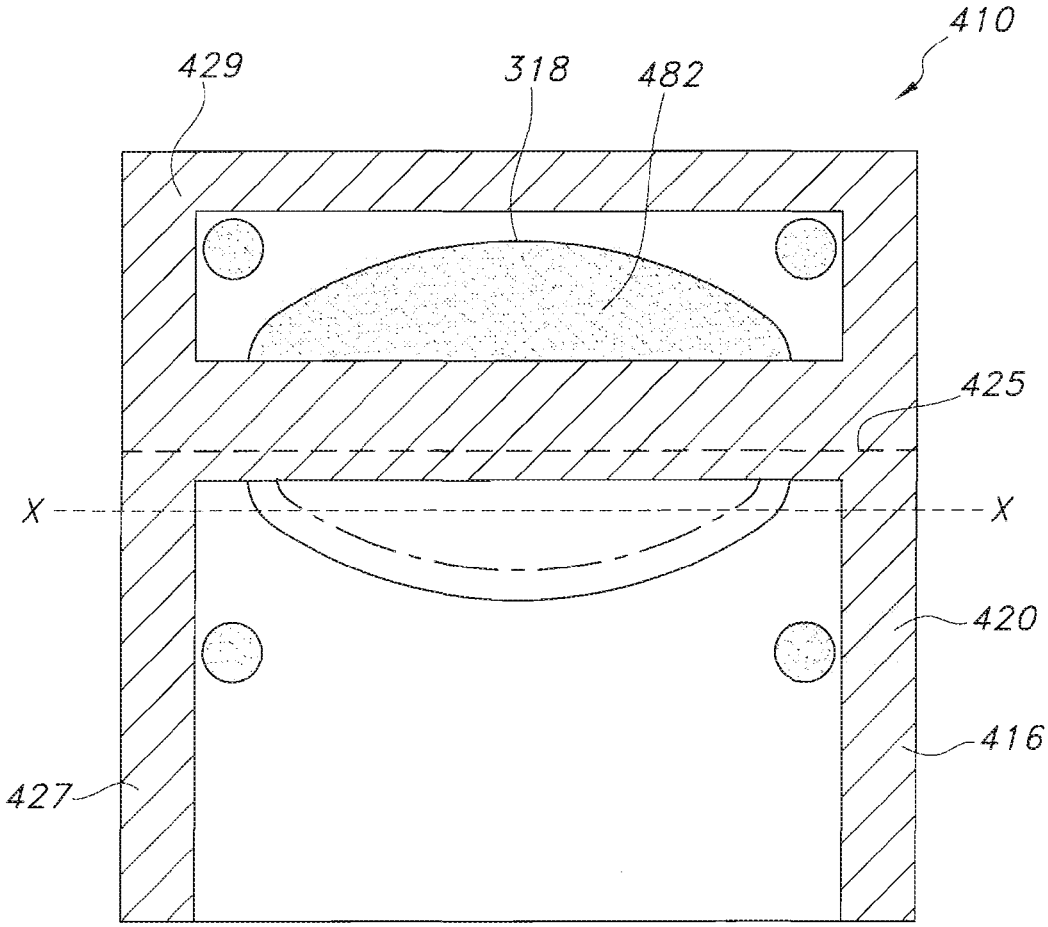
FIG. 15 shows a further embodiment of the pouch of the present invention having both a permanent and releasable adhesive.
Figure 16:
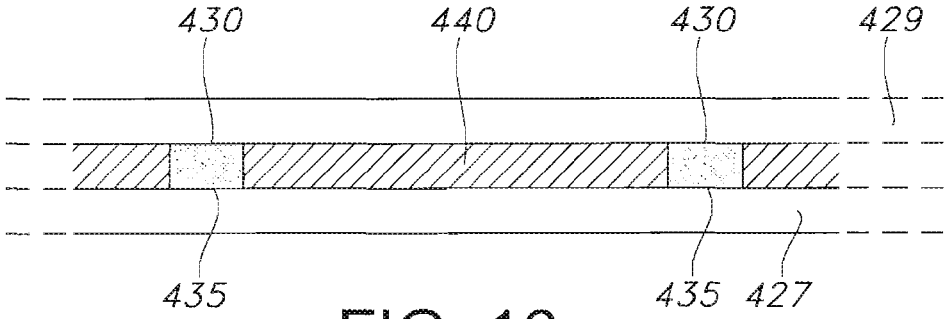
FIG. 16 is a sectional showing of the pouch of FIG. 15.

A still further embodiment of the present invention is shown in FIGS. 15-18. In this embodiment, the permanent adhesion of the flap to the bottom portion of the pouch is replaced by a combination of both a permanent adhesive and a resealable adhesive. The pouch 410 of the present embodiment is substantially similar to the embodiments described above including a sheet 416 which is folded to form the pouch. A heat seal is used on boundary location 420. The folded sheet 416 includes a fold line 425 extending thereacross which divides the pouch into a bottom portion 427 and a foldable flap 429. Upon folding the flap 429 over the lower portion 427, the flap is adhered thereto by a combination of a U-shaped releasable seat 430 and a permanent adhesive 440. As shown in FIGS. 15 and 16, a score 430 is placed through the flap 429 along the releaseable seal, while a second score 435 is placed through the lower pouch portion outwardly about the inner score 430. When the flap 429 is closed over the lower portion 429, an inner semi-circular portion of the flap 428 will be secured to the lower portion in a permanent fashion.

Figure 17:
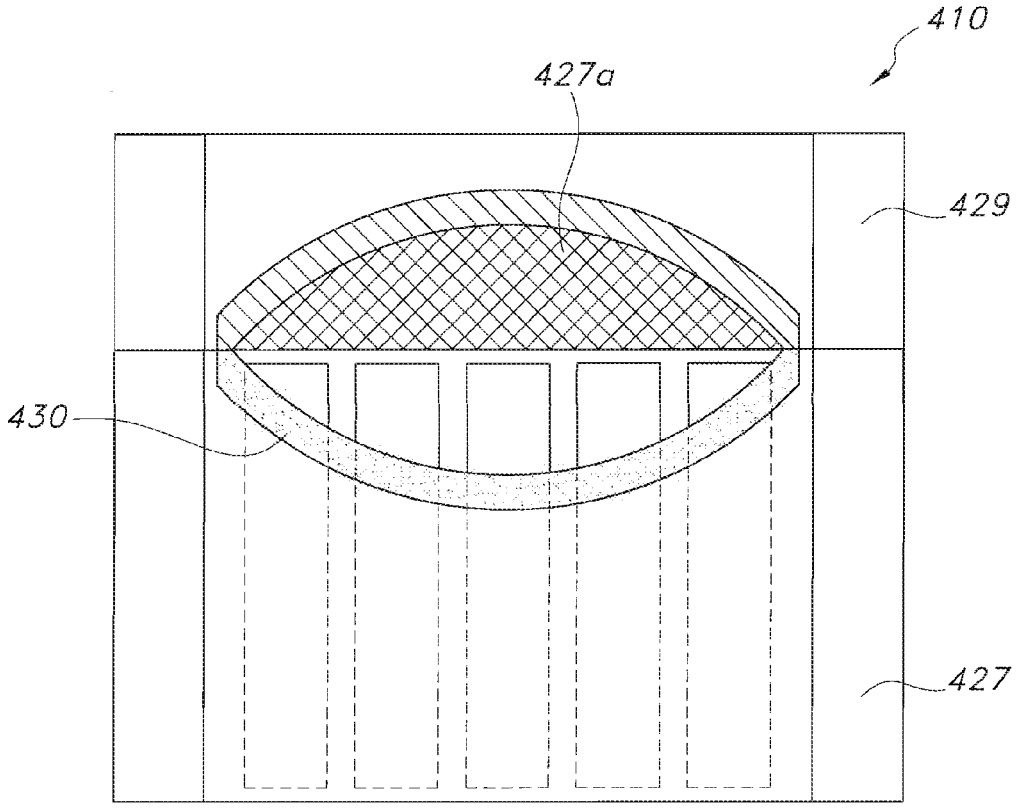
FIGS. 17 and 18 show the pouch of FIG. 16 in the open and reclosed conditions, respectively.
Figure 18:
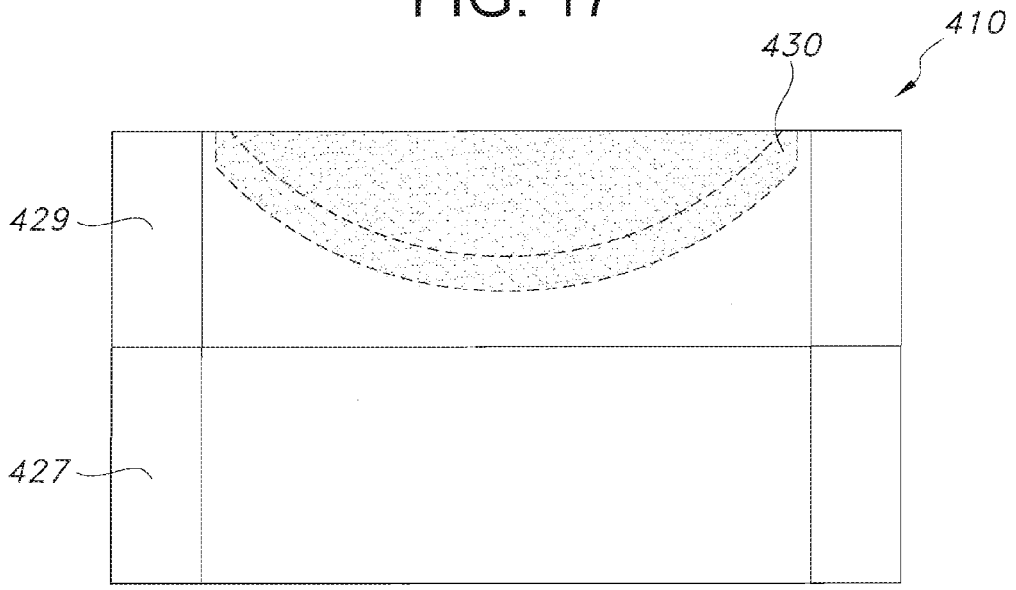

Referring to FIG. 17, when the flap 429 is opened, a semi-circular section 427*a* of the lower portion 427 will remain adhered to the flap 429 by the permanent adhesive and, because of the location of the score, will lift that segment off the lower portion 427 exposing the gum sticks contained therein. By virtue of the partial score line, the releasable adhesive 430 will remain on the lower portion such that the flap 429 can be reclosed as shown in FIG. 18 re-adhering the flap to the lower portion along the U-shaped releasable adhesive. This allows the flap to be reopened and reclosed several times allowing dispensing of the gum sticks over time.

Figure 19:
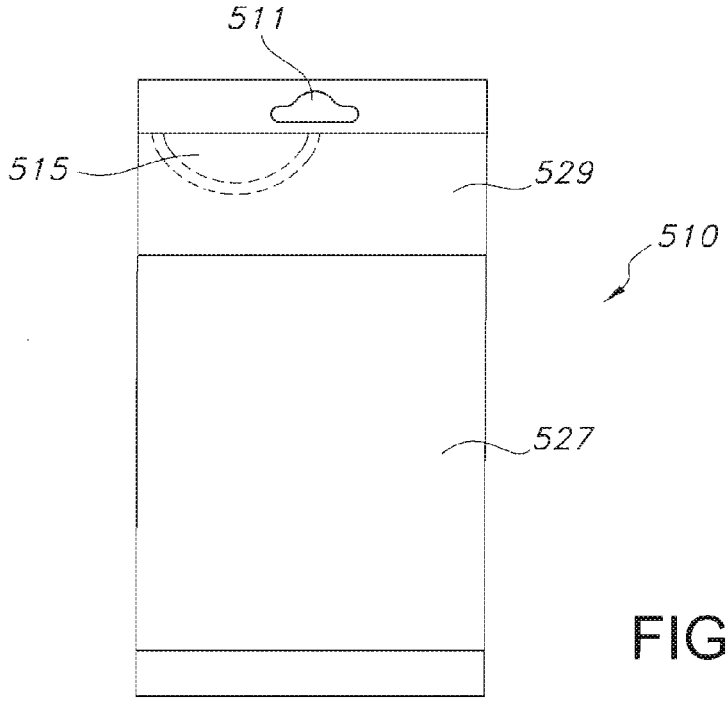
FIG. 19 is a plan view of a further embodiment of the present invention employing a hang tag.

Referring now to FIG. 19, a further embodiment of the present invention is shown. In this embodiment, a pouch 510 may be of the type used as a hang bag to display and merchandise gum sticks or the like. The upper extent of pouch 510 includes a hang tag with an opening 511 which may be used to hang the pouch from a peg or the like. Pouch 510 includes a flap 529 which is folded over a lower portion 527. In this embodiment, the flap 529 only fold over the upper extent of the lower portion 527. A semi-circular scored location 515 of the type described above can be used to open the package exposing the gum sticks for individual dispensing. The opening 515 is openable upon opening of the flap 529. The flap 519 is reopenable and reclosable with lower portion 527 using a releasable seal.

Figure 20:
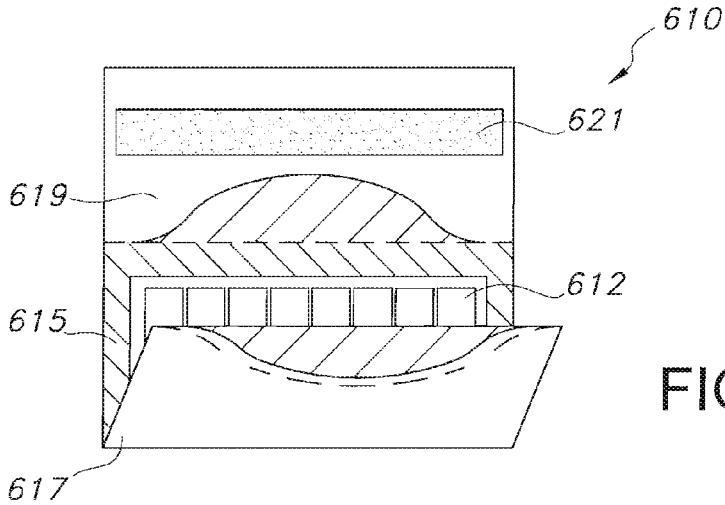
FIGS. 20 and 21 show further embodiments of the reclosable pouch of the present invention employing a foldable upper and lower flap.
Figure 21:
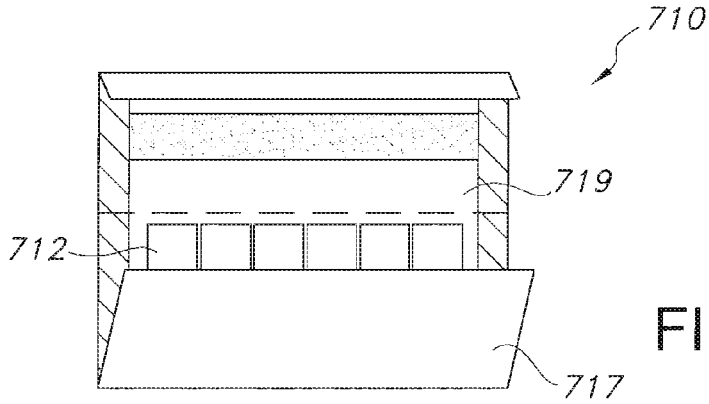

Referring now to FIGS. 20 and 21, still further embodiments of a reclosable pouch are shown. In one embodiment, the pouch 610 is used to support a plurality of consumable products 612. The pouch includes a back wall 615, a foldable lower front flap 617, and a foldable upper flap 619. The upper and lower flaps are folded to surround the product. The overlying of the upper flap over the lower flap together with a laser or scored out placed in one of the flaps exposes the product 612 for removal upon opening the flaps much in the manner as described above. A resealable adhesive 621 may be used to reopen and reclose the pouch 610.

Referring now to FIG. 21, a pouch 710 is substantially similar to pouch 610 described above. However, in this embodiment, the upper flap 719 is openable with respect to the lower flap 717 to expose the products 712 without use of a laser or score cut.

Figure 22:
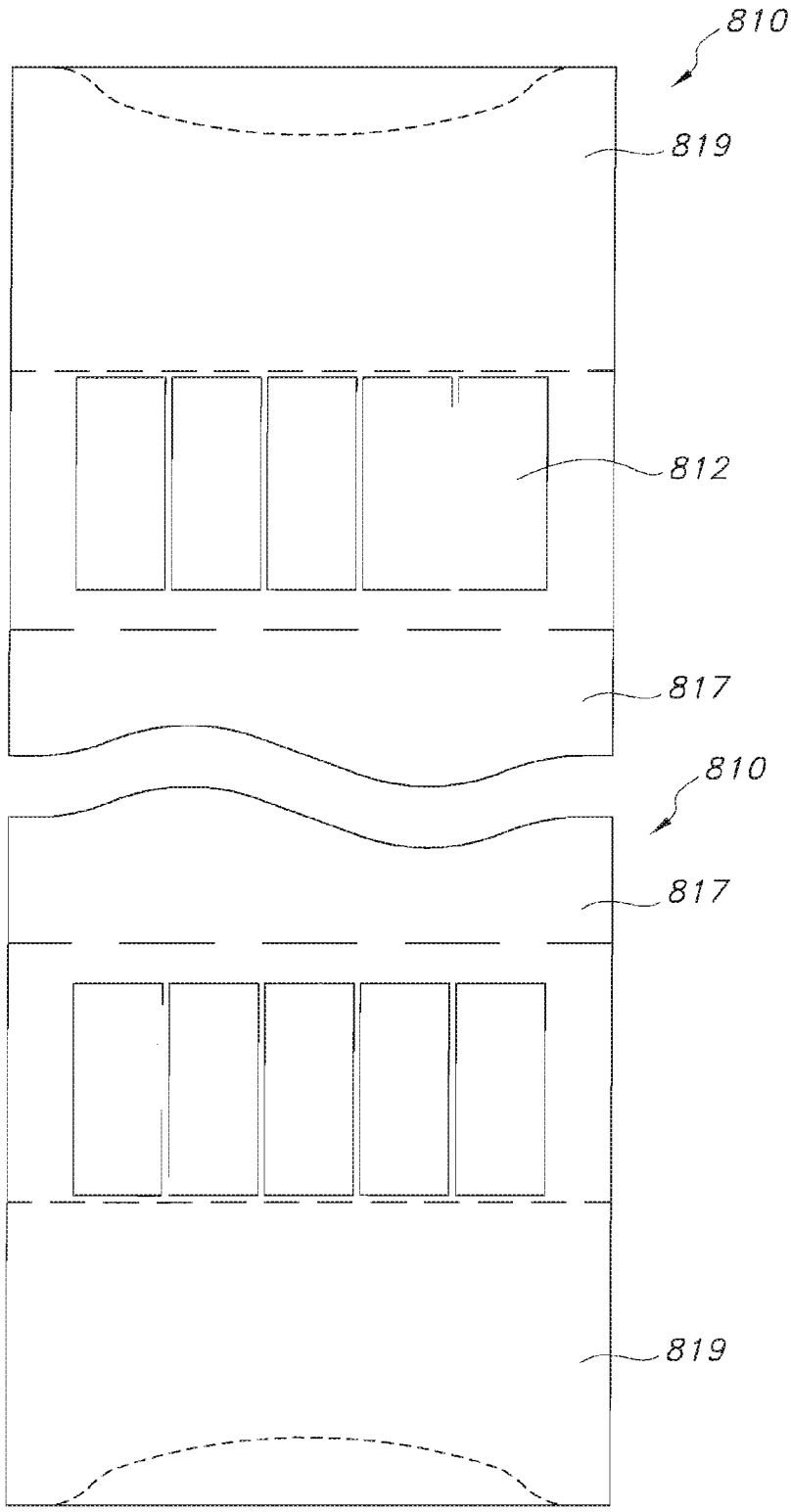
FIG. 22 shows a still further embodiment of the present invention where two vertically disposed pouches may be formed from a single sheet.

Referring to FIG. 22, a still further embodiment of the present invention is shown. Pouch 810 is used to support a plurality of gum sticks 812. The pouch 816 includes foldable upper wall 819 and a foldable lower wail 817. In forming the pouch from a sheet of material, the ends forming the lower flap 817 are formed vertically adjacent to one another by a single cut so that a material savings is achieved.

Items:

Item 1. A reclosable consumable product package assembly comprising:

a plurality of consumable products;

a product package for retaining and enclosing said products;

said package being formed by a planar sheet folded about said products; said folded sheet defining a portion overlying said products and an extending portion extending beyond said products to define a foldable flap;

said sheet being scored at a location overlying at least a portion of said products;

said foldable flap being folded over said scored location and adhesively secured thereto such that upon opening said flap said scored location is removed from said overlying location to expose said products for dispensing; and wherein said flap is reclosable over said exposed products.

Item 2. A reclosable package assembly of item 1 wherein said flap is releasably adhesively secured in said reclosed position.

Item 3. A reclosable package assembly of items 1-2 wherein said planar sheet is formed from foil.

Item 4. A reclosable package assembly of items 1-3 wherein said planar sheet is formed from combination of paper and foil.

Item 5. A reclosable package assembly of items 1-4 wherein said scoring is laser scoring.

Item 6. A reclosable package assembly of item 5 wherein said sheet is heat sealed about side edges thereof.

Item 7. A reclosable package assembly of items 1-6 wherein said products are elongate gum slabs arranged in a side-by-side array.

Item 8. A reclosable package assembly of items 1-7 wherein said planar sheet includes a flood coat heat seal on one surface thereof and cold seal locations on either surface thereof.

Item 9. A reclosable package assembly of items 1-8 wherein said cold seal locations include a permanent cold seal for engagement with said scored location and a releasable cold seal for reclosing said flap.

Item 10. A reclosable package assembly of items 1-8 wherein said planar sheet is supplied on a roll.

Item 11. A reclosable package assembly of items 1-7 wherein said product package has an over lacquer coating thereover.

Item 12. A reclosable package assembly of item 11 wherein overlying location includes an extent thereof containing no said over lacquer coating and wherein said extent includes a reclosable adhesive thereon.

Item 13. A reclosable package assembly of item 12 wherein said foldable flap is releasably adhesively engageable with said releasable adhesive on said overlying location.

Item 14. A reclosable package assembly of items 1-7 wherein said foldable flap is secured over said scored location with a permanent adhesive.

Item 15. A reclosable package assembly of item 14 wherein said foldable flap is further secured by a releasable adhesive.

Item 16. A reclosable package assembly of item 1 wherein said products are elongate gum sticks arranged in a face-to-face array.

Item 17. A reclosable package assembly of item 1 wherein said folded sheet includes a lower flap and wherein said lower flap includes said scored location.

Item 18. A reclosable package assembly of item 17 wherein said flap is foldable over said lower flap.

Various changes to the foregoing described and shown structures would now be evident to those skilled in the art. Accordingly, the particularly disclosed scope of the invention is set forth in the following claims.

What is claimed is:

1. A reclosable consumable product package assembly comprising:

a plurality of consumable products;

a product package for retaining and enclosing said products;

said package being formed by an individual planar sheet folded about said products; said sheet having an upper half supporting said products and a lower half, the lower half being pressed against the upper half, to enclose said products; wherein the folded individual planar sheet defines a portion overlying said products and an extending portion extending beyond said products to define a foldable flap;

said sheet being scored at a location overlying at least a portion of said products;

said foldable flap being folded over said scored location and adhesively secured thereto such that upon opening said flap said scored location is removed from said overlying location to expose said products for dispensing; and wherein said flap is reclosable over said exposed products to define a reclosed position.

2. A reclosable package assembly of claim 1 wherein said flap is releasably adhesively secured in said reclosed position.

3. A reclosable package assembly of claim 1 wherein said planar sheet is formed from foil.

4. A reclosable package assembly of claim 1 wherein said planar sheet is formed from a combination of paper and foil.

5. A reclosable package assembly of claim 1 wherein said sheet is laser scored.

6. A reclosable package assembly of claim 5 wherein said sheet is heat sealed about side edges thereof.

7. A reclosable package assembly of claim 1 wherein said products are elongate gum slabs arranged in a side-by-side array.

8. A reclosable package assembly of claim 1 wherein said planar sheet includes a flood coat heat seal on one surface thereof and cold seal locations on either surface thereof.

9. A reclosable package assembly of claim 8 wherein said cold seal locations include a permanent cold seal for engagement with said scored location and a releasable cold seal for reclosing said flap.

10. A reclosable package assembly of claim 8 wherein said planar sheet is supplied on a roll.

11. A reclosable package assembly of claim 1 wherein said product package has an over lacquer coating thereover.

12. A reclosable package assembly of claim 11 wherein said overlying location includes an extent thereof containing no said over lacquer coating and wherein said extent includes a reclosable adhesive thereon.

13. A reclosable package assembly of claim 12 wherein said foldable flap is releasably adhesively engageable with said releasable adhesive on said location.

14. A reclosable package assembly of claim 1 wherein said foldable flap is secured over said scored location with a permanent adhesive.

15. A reclosable package assembly of claim 14 wherein said foldable flap is further secured by a releasable adhesive.

16. A reclosable package assembly of claim 1 wherein said products are elongate gum sticks arranged in a face-to-face array.

17. A reclosable package assembly of claim 1 wherein said folded sheet includes a lower flap and wherein said lower flap includes said scored location.

18. A reclosable package assembly of claim 17 wherein said foldable flap is foldable over said lower flap.

19. A reclosable package of claim 1 wherein said upper half is sealably pressed against said lower half to sealably enclose said products.

* * * * *

UNITED STATES PATENT AND TRADEMARK OFFICE

CERTIFICATE OF CORRECTION

PATENT NO. : 8,607,980 B2
APPLICATION NO. : 13/146947
DATED : December 17, 2013
INVENTOR(S) : Aldridge et al.

It is certified that error appears in the above-identified patent and that said Letters Patent is hereby corrected as shown below:

In the Specification:

At column 3, line 39, the printed patent reads "...maintain the hairier properties..."; the patent should read --...maintain the barrier properties...--.

At column 4, line 9, the printed patent reads "...above, white a repositionable...'"; the patent should read --...above, while a repositionable...--.

At column 5, line 43, the printed patent reads "...wrapped guru sticks..."; the patent should read --...wrapped gum sticks...--.

At column 5, line 49, the printed patent reads "...rounded or curves as is..."; the patent should read --...rounded or curved as is...--.

At column 5, line 63, the printed patent reads "...releasable seat 430..."; the patent should read --...releasable seal 430...--.

At column 6, line 10, the printed patent reads "...adhesive 430 will remain..."; the patent should read --...adhesive 440 will remain...--.

At column 6, line 36, the printed patent reads "...scored out placed in...'"; the patent should read --...scored cut placed in...--.

At column 6, line 48, the printed patent reads "...lower wail 817..."; the patent should read --...lower wall 817...--.

Signed and Sealed this
Fifteenth Day of April, 2014

Michelle K. Lee

Michelle K. Lee
*Deputy Director of the United States Patent and Trademark Office*